US007270352B1

(12) United States Patent
Stuart

(10) Patent No.: US 7,270,352 B1
(45) Date of Patent: Sep. 18, 2007

(54) FOOT-OPERATED DOOR OPENER

(76) Inventor: Robert Stuart, 233 SW. 43rd Ter., Cape Coral, FL (US) 34221

( * ) Notice: Subject to any disclaimer, the term of this patent is extended or adjusted under 35 U.S.C. 154(b) by 0 days.

(21) Appl. No.: 11/185,269

(22) Filed: Jul. 20, 2005

Related U.S. Application Data

(60) Provisional application No. 60/589,293, filed on Jul. 20, 2004.

(51) Int. Cl.
*E05B 15/00* (2006.01)

(52) U.S. Cl. ..... 292/255; 292/336.3

(58) Field of Classification Search ..... 292/255, 292/336.3 X, DIG. 15, 225, DIG. 25, 174, 292/166; 49/55
See application file for complete search history.

(56) References Cited

U.S. PATENT DOCUMENTS

| | | | | | |
|---|---|---|---|---|---|
| 283,770 | A * | 8/1883 | Geiger | 292/255 |
| 584,588 | A * | 6/1897 | Headland | 292/255 |
| 1,084,830 | A * | 1/1914 | Tate | 292/255 |
| 1,172,205 | A * | 2/1916 | Gillentine | 292/255 |
| 1,603,722 | A * | 10/1926 | Stanley | 292/255 |
| 2,928,690 | A * | 3/1960 | Larson | 292/336.3 |
| 4,621,848 | A * | 11/1986 | Pierce | 292/336.3 |
| 5,193,863 | A * | 3/1993 | McBain | 292/255 |
| 5,217,265 | A * | 6/1993 | Lerner et al. | 292/200 |
| 6,176,042 | B1 * | 1/2001 | Rossman et al. | 49/463 |
| 6,360,488 | B1 * | 3/2002 | Darling | 49/274 |
| 6,499,254 | B2 * | 12/2002 | Rossman et al. | 49/55 |

* cited by examiner

*Primary Examiner*—Brian E. Glessner
*Assistant Examiner*—Mark Williams
(74) *Attorney, Agent, or Firm*—William E. Noonan

(57) ABSTRACT

A foot-operated door opener includes an elongate housing having openings at the upper and lower ends thereof. The housing is mounted to and hangs from a rotatable doorknob or door handle. An elongate actuator extends through the housing. An upper end of the actuator is grippably engaged with the door handle or doorknob and the lower end of the actuator carries a foot pedal. The lower end of the housing carries a hook that engages the lower edge of the door. The foot pedal is depressed to pull the actuator downwardly through the housing. This rotates the doorknob or door handle to open the door. The pedal is then pulled rearwardly or pushed forwardly by the users foot, as required, so that the housing and hook pivot the door open. The user may then exit the door without touching the handle.

18 Claims, 8 Drawing Sheets

FOOT-OPERATED DOOR OPENER

RELATED APPLICATION

This application claims the benefit of U.S. Provisional Patent Application Ser. No. 60/589,293 filed Jul. 20, 2004.

FIELD OF THE INVENTION

This invention relates to a foot-operated apparatus that allows a person to open a door without having to grasp the knob or handle or the door. More particularly, the invention relates to a foot-operated door opener especially suited for use in restrooms and other public facilities.

BACKGROUND OF THE INVENTION

A doorknob or door handle tends to collect all sorts of germs, which may be transmitted to persons who subsequently open the door. This problem is particularly acute in connection with knobs and handles employed by doors in public restrooms and other facilities used by the public. Once the knob or handle is contaminated, each person thereafter opening or closing the door encounters the risk of being infected and contracting a cold, flu or other disease. Contamination is best avoided by careful hand washing; however, many people using public facilities exhibit less than exemplary hygiene and either inadequately wash their hands or fail to wash them altogether. As a result, unsanitary and contaminated door handles and doorknobs remain an ongoing and serious health concern.

SUMMARY OF THE INVENTION

It is therefore an object of the present invention to provide a foot-operated door opener, which allows a person to open a door without having to touch the knob or handle of the door and which thereby enables that person to avoid collecting germs on his or her hand from the knob or handle.

It is a further object of this invention to provide a foot-operated door opener that significantly reduces the spread of germs, viruses and bacteria between persons handling a contaminated doorknob or door handle.

It is a further object of this invention to provide a foot-operated door opener that improves public health by reducing the risk of colds and illness being spread in public facilities.

It is a further object of this invention to provide a foot-operated door opener that significantly improves sanitation and reduces the transmission of germs in public restrooms, dining establishments and other public buildings and facilities.

It is a further object of this invention to provide a foot-operated door opener featuring a relatively simple and inexpensive construction, which is convenient and effective to utilize on virtually all types of doors employing knobs and/or handles.

It is a further object of this invention to provide a foot-operated door opener that is aesthetically and hygienically appealing as well as extremely convenient for use by the public.

This invention features a foot-operated door opener including an elongate housing that is mounted to the knob or handle of a door to be opened. The housing includes upper and lower openings. An elongate actuator is mounted within the housing for moving longitudinally therein. The upper end of the actuator carries a gripping device that is engaged with the handle or knob of the door. The lower end of the actuator carries a foot pedal. The foot pedal is depressed by a user's foot such that the actuator is pulled downwardly through the housing and the gripping device turns the knob or handle to release the door's latch and open the door.

In a preferred embodiment, a hook is carried by the lower portion of the elongate housing and the hook is engaged with a lower edge of the door. As a result, when the foot pedal is depressed, the actuator pulls the gripping member such that the handle or knob is turned and the door is opened. The user may then draw the foot pedal rearwardly (or push it forwardly) such that the hook pivots the door about its hinges into an open condition.

The elongate housing may comprise a tube having open upper and lower ends. The tube or other housing may be mounted by a strap or bracket onto the shaft of the doorknob or door handle. The hook may be carried by a lower end of the tube door housing.

The gripping device may include a strap, which is attached to the handle or knob, and which is at least partly flexible. The actuator may include a relatively rigid shaft, bar or rod that is moveable longitudinally within the tube. The gripping strap may be attached to an upper end of the shaft or rod. Alternatively, the actuator may comprise an elongate cord, chain, wire or other flexible element that is interconnected between the foot pedal and the doorknob or door handle. In still other embodiments, the gripping device may include a clamp or bracket that is fastened releasably to the doorknob or shaft of the knob. The clamp may be secured operably to the actuator by various means. For example, when the actuator includes an elongate shaft or rod, as previously described, the clamp may include an extension portion that is interconnected to the rod or shaft by a chain, wire, cord or similar connecting element. In still other embodiments, the actuator may include a shaft having an offset upper extension arm that is pivotally connected to an extension piece of the clamp. As the shaft is moved longitudinally downwardly within the housing, the offset arm drives the clamp extension downwardly such that the clamp rotates the doorknob or door handle shaft into an opened condition. In such versions, the housing is typically wide enough that the shaft can move laterally within the housing as it moves longitudinally therein. When the pedal is released, the spring in the door handle rotates the handle to its initial position and, as a result, the clamp draws the actuator upwardly through the housing.

In alternative embodiments of this invention, the door opener may include an elongate body that carries a mounting plate at its upper end. The mounting plate is positioned behind the base of the doorknob or door handle or, alternatively, behind a push plate of the door. The mounting plate includes openings which enable the mounting plate to be secured to the door when the push plate or base of the knob or handle is secured to the door. The previously described elongate housing may be replaced by an elongate body that does not include the previously described actuator. Instead, a foot pedal may be secured directly to the lower end of the body. A lower bracket may be carried by the lower end of the body and engaged with the bottom of the door. The user may open the door by simply stepping on the foot pedal and pushing or pulling the door open as required. This version is particularly useful for doors which do not include knobs or handles that must be pivoted to open the door. In other words, it is particularly suited for use with unlatched doors.

DETAILED DESCRIPTION OF PREFERRED EMBODIMENTS

Other objects, features and advantages will occur from the following description of preferred embodiments and the accompanying drawings, in which.

Figure 5:
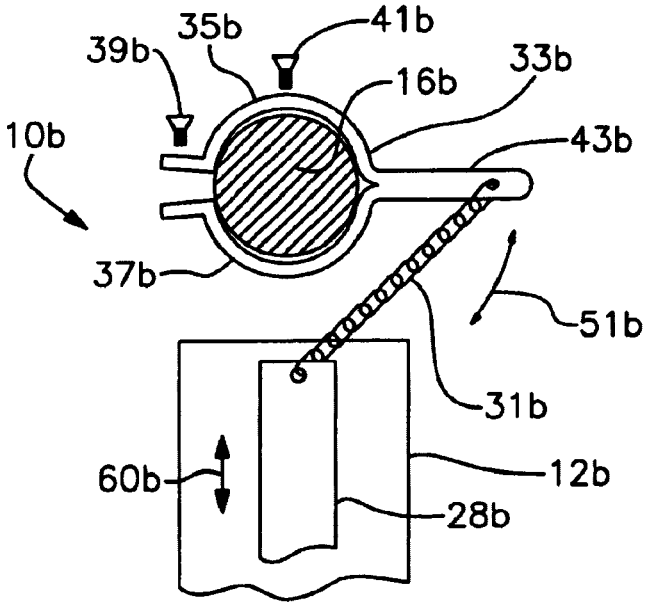
Figure 6:
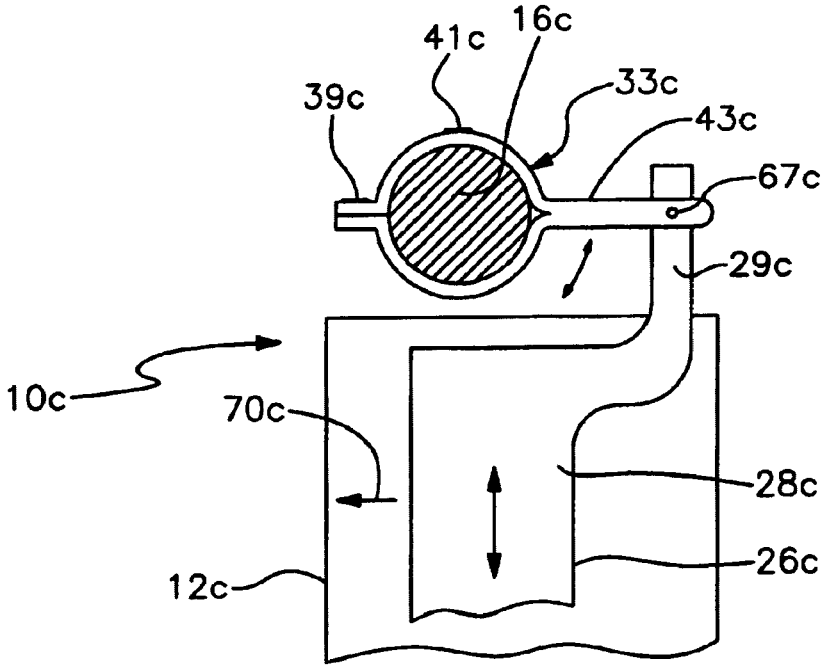

FIG. 5 is a fragmentary cross-sectional view of the upper end of an alternative door opener employing a clamp that is engaged with the shaft of a door handle or doorknob; and FIG. 6 is a view similar to FIG. 5 of still another version of this invention wherein the door opener includes an actuator having an offset upper extension arm for operating a clamp that is attached to the shaft or a doorknob or door handle.

Figure 7:
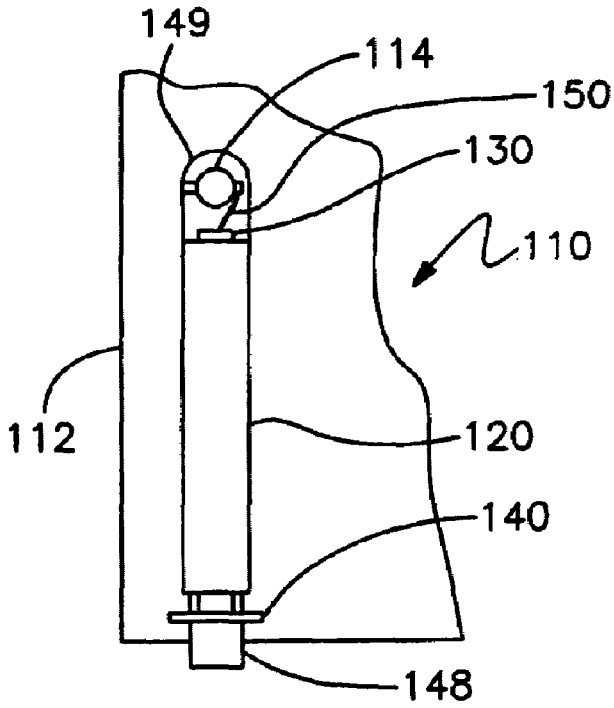
Figure 8:
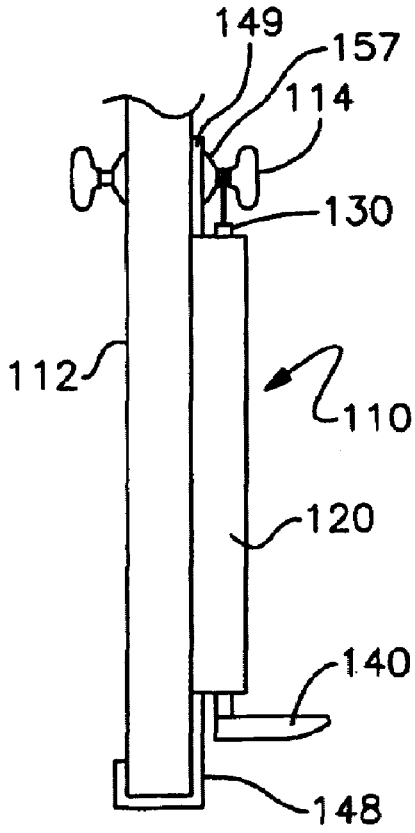
Figure 9:
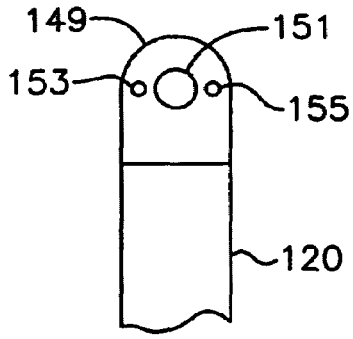
Figure 10:
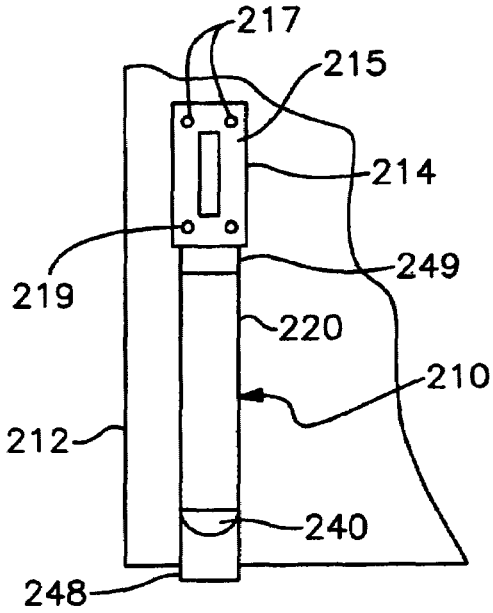
Figure 11:
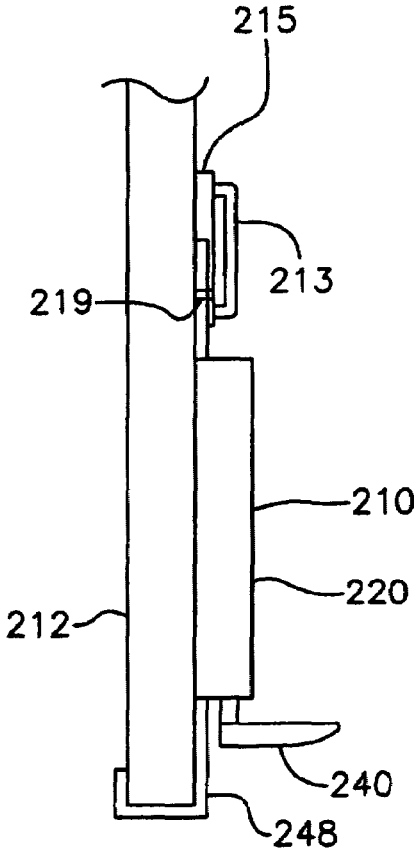
Figure 12:
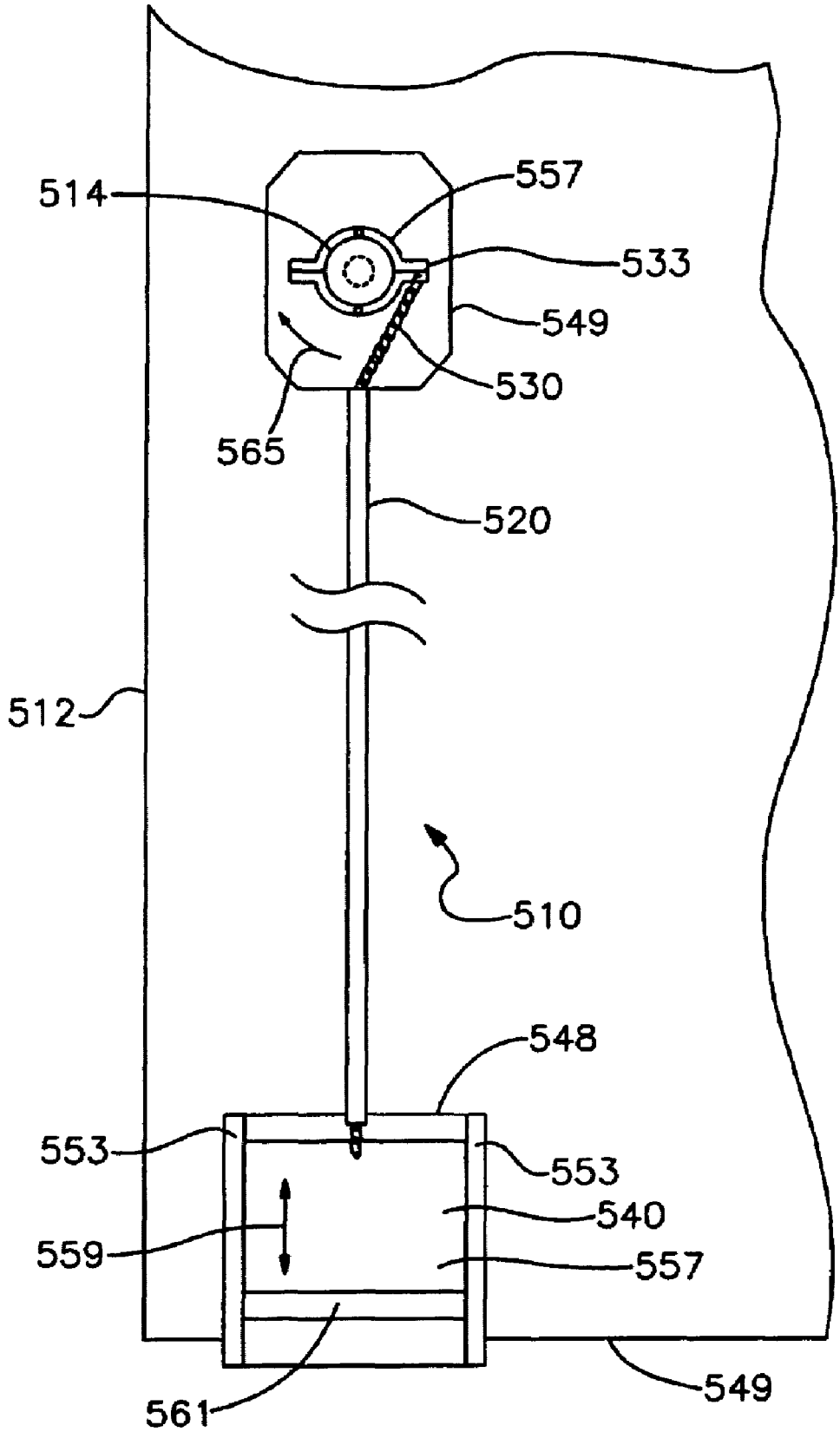
Figure 13:
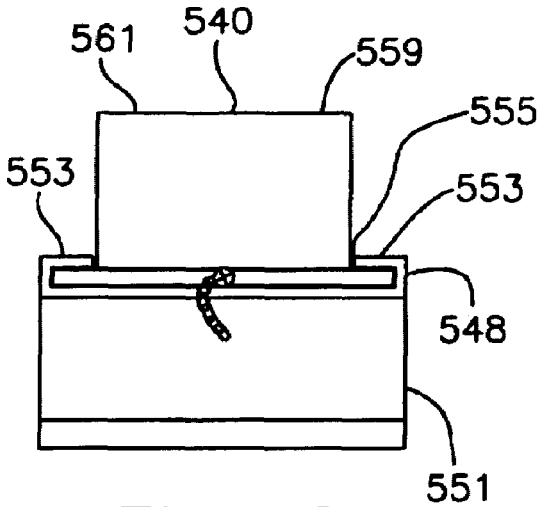
Figure 14:
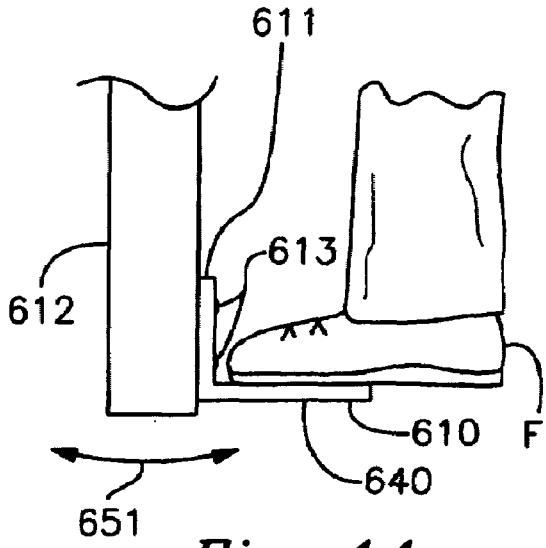
Figure 15:
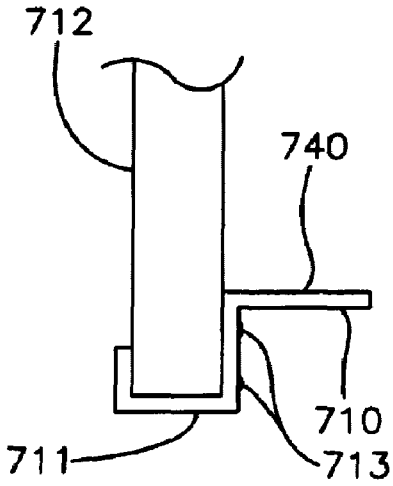

FIG. 7 is an elevational front view of an alternative door opener that employees a mounting plate at its upper end, which plate is mounted behind the base of the doorknob to attach the door opener to the door;

FIG. 8 is a side elevational view of the apparatus of FIG. 7;

FIG. 9 is an elevational view of the upper end of the door opener of FIGS. 7 and 8;

FIG. 10 is a front elevational view of an alternative door opener and according to this invention, which is mounted behind the base plate of an unlatched door handle;

FIG. 11 is a side elevational view of the apparatus of FIG. 10;

FIG. 12 is a front elevational view of still another version of the door opener;

FIG. 13 is a top view of the lower bracket and foot pedal of the device of FIG. 12;

FIGS. 14 and 15 are side elevational views of alternative door openers comprising a lower bracket for engaging the bottom of the door and a foot pedal.

Figure 1:
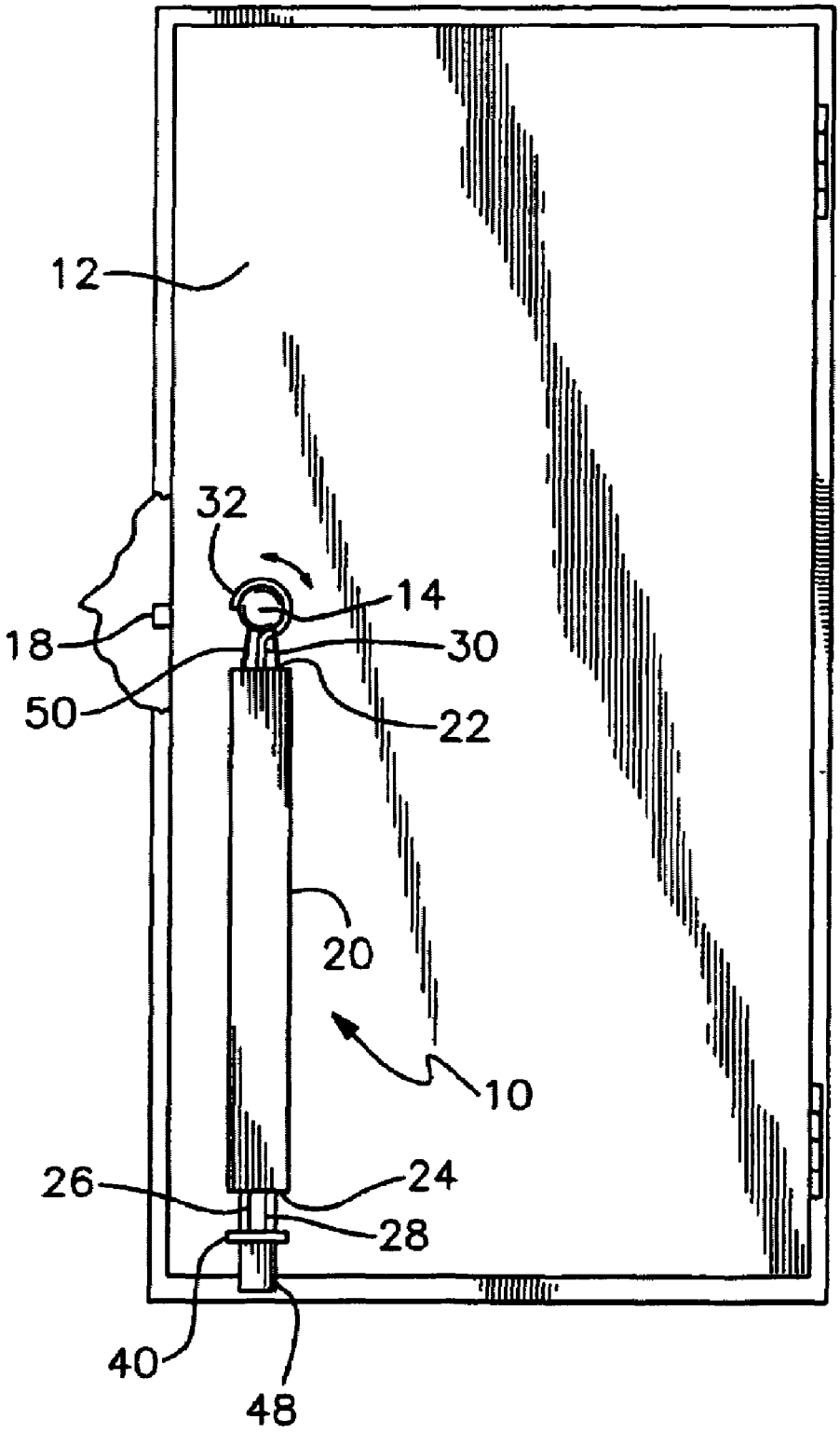
FIG. 1 is a front elevational view of the foot-operated door opener of this invention.
Figure 2:
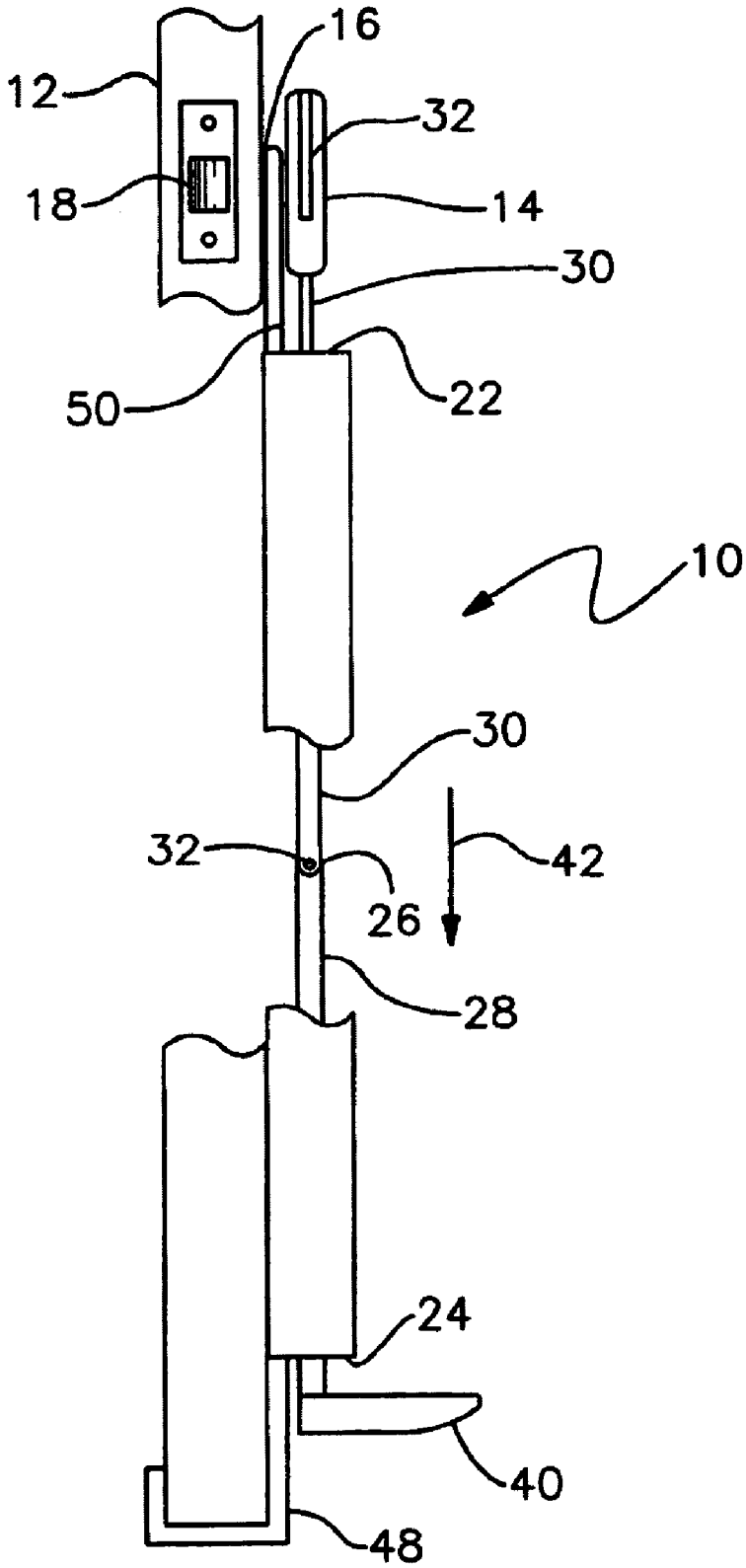
FIG. 2 is a side elevational, partly cut-away view of the door opener of FIG. 1 engaged with a door to be opened.

There is shown in FIGS. 1 and 2 a foot-operated door opener 10 that is operably engaged with a door 12. Opener 10 is typically mounted to the inside of the door. The opener is particularly effective for use in connection with the doors of public buildings and facilities, and especially public restrooms. Door opener 10 is designed for use with doors that employ a knob, handle, lever or other component that is normally grasped and turned to release the door latch and thereby open the door. In the versions show in FIGS. 1 and 2, door 12 employs a conventional knob 14 that is rotatably mounted to the door by means of a shaft 16. Turning knob 14 in respective directions operates a standard door latch 18. It should be understood that the knob, latch and remaining components of the door are conventional and do not comprise a part of this invention. The door opener may be employed with virtually any type of door that employs a handle, knob or other component that is normally grasped and turned to open the door. It should be understood that opener 10 is used primarily on the inside of the door so the person leaving the restroom or other public facility can open the door conveniently without touching the knob or handle. As used herein, the term "handle" should be construed as including all types of door handles and knobs.

In each version of the invention, the opener includes an upper portion attached to the door handle, a lower portion secured to the bottom of the door and an intermediate portion attached to and extending between the upper and lower portions. In some embodiments, the upper and intermediate portions operate the handle through action of the user's foot. In other versions, a passive intermediate is provided between a foot pedal and the door handle.

Door opener 10 includes an elongate tubular housing component 20 having open upper and lower ends 22 and 24 respectively. Tubular housing 20 may be composed of various types of metals or plastics. The housing can have a cylindrical or rectangular configuration, although other non-cylindrical shapes may be utilized. The upper end of housing 20 carries a strap or bracket so that it hangs the housing from doorknob shaft 16.

An engagement component comprising a hook 48 is engaged with the lower edge of door 12. Hook 48 is attached to and extends downwardly from the lower end 24 of housing 20. The hook component is extendable beneath and engagable with the lower edge of the door as shown in FIG. 2.

Figure 3:
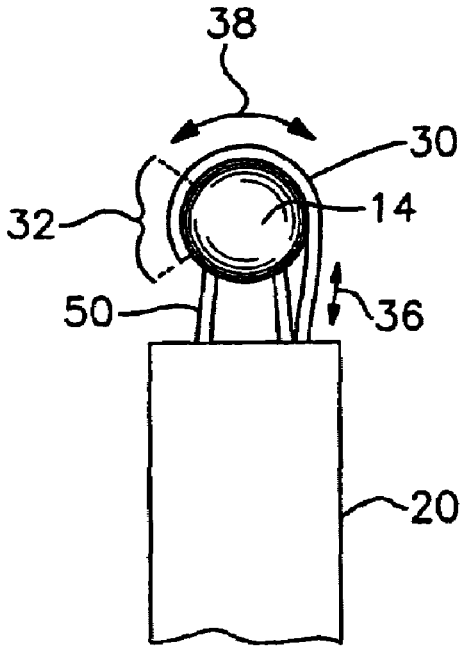
FIG. 3 is a fragmentary front elevational view of the upper end of the door opener engaged with a doorknob.

An elongate actuator 26 is mounted within tubular housing 20. In the version shown in FIGS. 1 and 2, actuator 26 includes an elongate bar, rod or shaft 28, having a lower end that extends through and below the lower opening 24 of tubular housing 20 and an upper end that terminates within the housing. The actuator further includes an elongate cord or strap 30 that is secured to the upper end of rod 28 by a pin 32 or other means of attachment. Strap 30 extends upwardly through the open upper end 22 of housing 20. The distal end of strap 30 is fastened to the circumference of knob 14. As best shown in FIG. 3, flexible element 30 may comprise a flexible plastic strap that is windably engaged with the knob 14. A distal segment 32 of the strap is secured by an adhesive to the circumference of knob 14. The remainder of plastic strap 30 is engaged but not adhered to the circumference of the knob. As a result, strap 30 may be driven longitudinally through housing 20 as indicated by double-headed arrow 36 in FIG. 3, and this motion, in turn, rotates knob 14 as indicated by double-headed arrow 38. Strap 30, and indeed any type of flexible strap, cord or other flexible component 30 is driven to move longitudinally through housing 20 in the manner described more clearly below.

The lower end of actuator shaft 28 carries a foot pedal 40, FIGS. 1 and 2, which is attached to the shaft by bolts or other means of connection. When the user steps upon the upper surface of the pedal and depresses the pedal, this pulls actuator shaft 28 downwardly as indicated by arrow 42 in FIG. 2. This, in turn, pulls flexible element 30 downwardly so that the knob 14 is rotated by the attached distal end segment 32 of element 30. Turning the knob in this manner opens latch 18 and thereby allows door 12 to be opened.

Door opener 10 is mounted on the inside of door 12 quickly and conveniently. Initially, hook component 48 is interengaged with the lower edge of door 12 in the manner shown in FIGS. 1 and 2. Tubular housing 20 is then positioned to extend vertically upwardly between the lower edge of the door and knob 14. Strap or bracket 50 loops over the doorknob shaft 16. This holds housing 20 and actuator 26 in a generally vertical condition between the lower edge of the door and doorknob 14. The upper end of flexible element 30 is then interengaged with the circumference of knob 14. An adhesive may be used to secure the distal end of the plastic strap, cord or other flexible element to the knob as shown in FIGS. 1-3. Screws, Velcro™ or other means of attachment may also be employed. The door opener is now mounted onto the door and ready to be utilized so that the door can be opened without the user having to touch the knob directly.

After a person has finished using the restroom or otherwise desires to exit through door 12, he or she operates the mounted door opener to open door 12 in a hands-free manner. To accomplish this, the user simply steps upon and depresses pedal 40. This pulls shaft 28 and flexible component 30 longitudinally downwardly through tubular housing 20. The distal end 32 of flexible component 30 rotates the knob in a clockwise direction to release latch 18 and open door 12. The user continues to draw or pull his or her foot rearwardly so that housing 20 and attached hook 48 pull the door 12 pivotably open. The user may then exit the room without directly touching the knob with his or her hands. Germs are avoided and the risk of the user contracting an illness or disease are significantly reduced.

Figure 4:
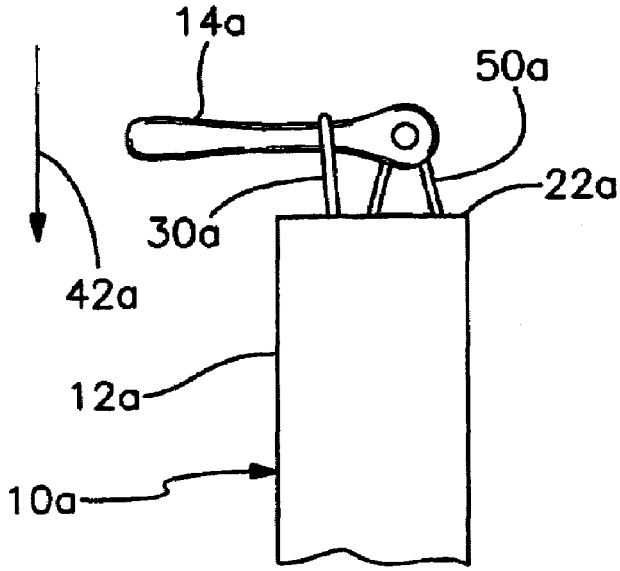
FIG. 4 is a fragmentary, front elevational view of the version of the door opener engaged with a pivoting door handle or lever.

In the alternative version shown in FIG. 4, door opener 10*a* again includes a tubular housing 12*a* that is hung on a lever-type door handle 14*a* by means of a strap or bracket 50*a* that is looped over and hung onto the pivot shaft of handle 14*a*. The actuator, which may be analogous to the previously described actuator, includes a flexible component 30*a* that extends upwardly through the opened upper end 22*a* of tubular housing 12*a*. The upper distal end of flexible component 30*a* is secured to handle 14*a*. In this version, a pedal and actuator rod similar to the components shown in the previously described version, may also be used. Alternatively, the flexible component 30*a* may extend completely through housing 12*a* and be attached at its lower and directly to the foot pedal. In either case, the foot pedal is selectively depressed to pull component 30*a* downwardly as indicated by arrow 42*a*. This rotates handle 14*a* which, in turn, opens the door. The pedal is then pulled or drawn rearwardly by the user's foot to open the door as in the previously described embodiment. Once again, a hook is carried at the lower end of housing 12*a* and this hook interengages the lower edge of the door so that the door is opened when the pedal is pulled rearwardly by the user's foot.

Still another version of the door opener is depicted in FIG. 5. Therein, a tubular housing 12*b* accommodates an elongate actuator shaft 28*b*, which is moveable upwardly and downwardly, with a housing 12*b* as indicated by double-headed arrow 60*b*. The upper end of shaft 28*b* is interconnected by a chain, cord or other element 31*b* to a gripping clamp 33*b*. Clamp 33*b* comprises a split ring or annular component, having arms 35*b* and 37*b* that diverge from a clamp extension piece 43*b*. Typically the ring is composed of plastic or other resiliently flexible material. Arms 35*b* and 37*b* are spread apart and the clamp is engaged (wrapped about) doorknob or door handle shaft 16*b*. The ends of the clamp arms 35*b* and 37*b* are then secured together, such as by a screw 39*b*. A set screw 41*b* fastens the clamp to doorknob shaft 16*b*. Clamp extension 43*b* is connected to an upper end of chain or cord 31*b*, which, in turn, joins clamp 33*b* to the upper end of actuator shaft 28*b*

The version of FIG. 5 operates in a manner analogous to the previously described embodiments. Initially, door opener 10*b* is installed on the inside surface of a restroom door or other type of publicly-used door. Once again, the lower end of housing 12*b* carries a hook that is engaged with the lower edge of the door. To exit the door without touching the handle, the user steps on the foot pedal carried at the lower end of shaft 28*b*. This causes the shaft to pull chain 31*b* downwardly so that clamp 33*b* and attached shaft 16*b* are rotated in a clockwise direction as indicated by arrow 51*b*. This opens the door, which may then be pulled open by the users foot as previously described. In all cases, after the user has exited the room and released their foot from the foot pedal, the latch spring in the door causes the doorknob or door handle to pivot back into its original closed condition. This pulls the actuator and foot pedal upwardly within the housing. A standard door closer then pulls the door closed automatically.

In the version shown in FIG. 6, an annular clamp 33*c* is again secured to the doorknob or handle shaft 16*c*. Fastening screws 39*c* and 41*c* secure the clamp in place about the shaft. Actuator 26*c* includes an elongate shaft 28*c* that carries an integral extension arm 29*c* at its upper end. Arm 29*c* is offset somewhat from the longitudinal axis of shaft 28*c*. The extension arm is operably connected to extension 43*c* of clamp 33*c* by a pivot pin 67*c*. The remaining features of the door opener 10*c* shown in FIG. 6 are similar to those in the previously described embodiments.

In operation, opener 10*c* is mounted on the inside of a door in the manner previously described. The user again steps on the foot pedal and depresses the actuator such that it is drawn longitudinally downwardly through housing 12*c*. As the elongate shaft 26*c* is pulled downwardly, it likewise pulls extension arm 29*c* in a downward direction. The extension arm causes clamp 33*c* to rotate the doorknob or handle shaft 16 in a clockwise direction. At the same time, the extension arm 29*c*, which is linked to extension 43*c*, is drawn laterally within housing 12*c* as indicated by arrow 70*c*. In the version shown in FIG. 6, the tubular housing should be wide enough to accommodate such lateral motion by the actuator. The articulating motion between the actuator and the clamp causes the shaft 16 to rotate, which in turn, causes the door to open. Again, the foot pedal may be drawn rearwardly to open the door so that the user does not have to touch the door handle or doorknob with his or her hands. When downward pressure upon the foot pedal is released, the doorknob or handle returns to its original closed position and the door is allowed to close on its own.

In FIGS. 7 and 8 an alternative door opener 110 is shown mounted to a door 112. Once again, door opener 110 includes a tubular housing 120 that accommodates an elongate, vertically moveable actuator 130. A flexible cord 150 is secured between actuator 130 and doorknob 114 in a manner similar to that previously described. The lower end of actuator 130 carries a foot pedal 140. A bracket 148 is attached to and hangs from housing 120. The bracket interengages door 112 in the manner shown and previously described.

In the version of FIGS. 7 and 8, housing 120 is mounted to the door by a mounting plate 149, best shown in FIG. 9. Plate 149 includes a flat plate that is attached unitarily or otherwise to the upper end of housing 120. As best shown in FIG. 9, plate 149 includes a relatively large central opening 151 and a pair of smaller, bolt accommodating openings 153 and 155. As best shown in FIG. 8, plate 149 is inserted between base 157 of doorknob 114 and the planer surface of door 112. More particularly, the internal handle mechanism of the doorknob is accommodated through opening 151. Bolt accommodating holes 153 and 155 are positioned to correspond with the standard doorknob mounting bolts. These bolts are inserted through the doorknob base and the holes 153 and 155. As a result, plate 149 is secured between the doorknob and the face of the door. This supports opener 110 in position against the door and holds the door opener securely in place. Opener 110 is then operated in the previously described manner.

FIGS. 10 and 11 depict still another embodiment of the invention wherein door opener 210 is mounted to a door 212 that employs a latch-free handle 214. In the version shown of FIGS. 10 and 11, handle 214 includes a generally vertically disposed handle element 213 mounted on a generally flat mounting plate 215. The mounting plate is itself secured to the door by appropriate screws or bolts 217.

In the version shown in FIGS. 10 and 11, there is no knob or lever type handle which must be turned to unlatch and open the door. Accordingly, door opener 210 does not require the use of the previously described actuator. Instead, opener 210 includes an elongate body 220 which may be either solid or hollow. Preferably, in this version and the other versions of the invention, the elongate body or housing hanging from the knob or handle has a generally rectangular or flat shape that fits conformably against the face of the door. This provides an attractive appearance and minimizes movement of the body or housing during operation of the door opener. Typically, the flat surface engaging the door will be somewhat wider than the profile extending outwardly from the door.

A mounting plate 249, which is analogous to the mounting plate described in the embodiment of FIGS. 7 through 9, is attached to and extends upwardly from the upper end of elongate body 220. This mounting plate includes bolt accommodating holes that are aligned and received the standard lower mounting bolts 219 used to secure the mounting plate 215 to door 212. This attaches the door opener securely to the door.

Once again, a foot pedal 240 is attached to a lower end of the door opener. In particular, foot pedal 240 is welded or otherwise permanently fastened to the lower end of elongate body 220. The foot pedal extends outwardly from the body so that it is conveniently accessible to a user desiring to open the door. A mounting bracket 248 is likewise secured to the lower end of body 220 for engaging the bottom of door 212.

The version of FIGS. 10 and 11 is operated in a manner somewhat similar to the previously described embodiments. A person desiring to open door 212 without touching handle 213 simply steps on pedal 240 and either pushes or pulls the unlatched door open. The user does not have to touch the handle and the risk of picking up germs from the handle is reduced.

Some types of latch-free doors employ only a push plate without any type of handle. In these situations, door opener 210 may be secured beneath the push plate of the door. The mounting plate includes holes that align with the bolt accommodating holes in the push plate. The bolts that secure the push plate to the door also fasten the door opener between the door and the push plate.

In still another version depicted in FIG. 12, door opener 510 includes an elongate tube 520 forming the intermediate portion. The upper end of tube 520 is secured by an upper portion comprising a mounting plate 549 that is secured behind the base 557 of door handle 514 in a manner analogous to that previously described. A two-piece clamp 533 engages and squeezes or pinches the circumference of the door handle shaft.

Tube 520 is attached to a lower end of plate 549 and extends downwardly from the plate and along a first side of door 512. The lower end of tube 520 is attached to a lower portion or bracket 548 that is itself secured to the bottom 549 of door 512. More particularly, bracket 548 includes a hook portion 551, FIG. 13, that extends beneath the door and engages the opposite side of the door.

A foot pedal assembly 540 is retractably mounted to bracket 548. As shown in FIGS. 12 and 13, the lower bracket 548 includes a pair of inwardly turned lips 553 that define a track 555 in bracket 548. A vertical plate 557 of foot pedal assembly 540 is slidably received in track 555. The plate 557 slides upwardly and downwardly within track 555 as indicated by doubleheaded arrow 559. A horizontal step 561 extends outwardly from plate 557. The step accommodates the user's foot and allows the pedal to be operated in accordance with this invention. An actuator chain 530 is interconnected between clamp 553 and plate 557 of pedal assembly 540. The chain extends through tube 520.

With the door in a closed and latched condition, the handle 514 and attached clamp 553 hold chain 530 such that pedal assembly 540 is supported in a raised condition. To open the door, the user steps on step 561 of pedal assembly 540 and pushes the pedal assembly downwardly within the track 555 of bracket 548. This pulls chain 530 downwardly through tube 520. The chain turns clamp 553 and pinched door handle 514, as indicated by arrow 565. This causes the door to unlatch. The user then either pulls or pushes against the pedal assembly and lower bracket, as required, to open the door 512. As in the prior embodiments, the door is opened without the user touching the door handle with his or her hands. Contamination is thereby avoided.

FIG. 14 discloses an alternative door opener 610 comprising an L-shaped component that includes a vertical door mounting plate 611 and a horizontal foot pedal 640. The door mounting plate and foot pedal are unitarily interconnected and may comprise various types of high-strength and durable materials such as metal or plastic. Plate 611 is secured to an inside surface of door 612 by screws, bolts or other means 613.

An alternative door opener 712 is depicted in FIG. 15. In this version, a door-mounting bracket 711 comprises a hook-shaped component that engages the bottom edge and the lower opposing sides of door 712. Bolts or other means 713 fasten bracket 711 to door 712. A foot pedal 720 is unitarily attached to an upper end of bracket 711 and extends generally horizontally from one side of door 712. The materials used may be analogous to those employed in the version of FIG. 14.

In the versions shown in FIGS. 14 and 15, the user opens the door simply by stepping on the upper surface of the pedal. This is best depicted by foot F shown engaging pedal 640 in FIG. 14. The user then either pushes or pulls the pedal so that the door swings open as indicated by doubleheaded arrow 651. This embodiment is far simpler than the other embodiments disclosed in this invention. It simply employs a lower bracket for attaching to the door and a foot pedal that extends horizontally from the bracket. No direct interengagement is provided between these components and the door handle. These versions are particularly useful for swinging or unlatched doors that do not require the turning of a handle to unlatch and open the door.

It should be noted that various alternative features and elements may be employed within the scope of this invention. Assorted types of stirrups, pedals and other foot-engagable components may be carried at the lower end of the actuator. The actuator itself may comprise a single unitary element or multiple interconnected sections, such as the rigid shaft, flexible strap, and/or gripping distal end segment described herein. The actuator may include rigid components such as a rod, bar or shaft. Alternatively, it may feature exclusively flexible components such as chain, wire, strap, cord or cable. In still other versions both flexible and rigid elements may be used. Although a tube or housing is disclosed in a number of the drawings, in some versions, the housing may be eliminated.

The door opener may be mounted to either the inside or outside of a door. The foot pedal may be engaged with either a pushing or a pulling action, as required, to open the door.

The present invention achieves very significant advantages and constitutes a great sanitary and public health improvement over the conventional practice of having to directly touch a door handle or doorknob in a public restroom or other facility widely utilized by the general public. The device described herein allows a person to open the door and exit the room without ever having to touch the knob or handle with his or her hands. Germs and diseases are thereby avoided and the risk of the illness is significantly reduced. The door opener may be constructed of various alternative materials and be made in different sizes suitable for accommodating virtually all types and sizes of pivoting handle doors.

The door opener of this invention will be especially attractive for use in restroom facilities employing automated hand drying devices. When used in conjunction with such dryers, the door opener of this invention eliminates virtually any need for the user of the facilities to touch any part of the inside of the restroom after washing his or her hands. Appropriate signage may be mounted to the door such as "For Sanitation" or "Germ Free", with an arrow pointing to the foot pedal. This will direct the users attention to the door opener so that it can be used consistently and effectively.

The mounting plate may be used in any of the embodiments to this invention. When it is used with the versions employed in conjunction with door knobs and pivoting door handles, the mounting plate does not interfere with operation of the handle or knob in any way. The handle and knob is allowed to turn freely so that the door is opened and the user can quickly and conveniently exit the room.

From the foregoing, it may be seen that the apparatus of this invention provides for a low cost, convenient to use and highly effective hands-free door opener. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principals of the invention, and is not limitative thereof.

Although specific features of the invention are shown in some of the drawings and not others, this is for convenience only, as each feature may be combined with any and all of the other features and put to other uses in accordance with this invention.

Other embodiments will occur to those skilled in the art and are within the following claims:

What is claimed is:

1. A foot operated door opener comprising:

an elongate assembly for interconnecting a door handle and a bottom end of the door, said elongate assembly including an upper portion for mounting to the door handle on a first side of the door, a lower portion for securing the bottom of the door and an intermediate portion interconnecting said upper and lower portions and for extending along a first side of the door between the handle and the lower end of the door; and a foot pedal attached to said intermediate portion for being engaged by a person's foot and selectively pushed or pulled to open the door;

said upper portion including a device for operably gripping the door handle and said intermediate portion including an actuator attached to said gripping device such that when said pedal is depressed, said gripping device operates said handle to release the door's latch and allow the door to be opened by pulling or pushing the door pedal; said intermediate portion further including an elongate housing that slidably receives said actuator and said upper portion further including a mounting piece for releasably engaging said housing to a mounting shaft of the door handle; said foot pedal being fixedly attached to a lower segment of said actuator below said housing.

2. The apparatus of claim 1 in which said housing includes an elongate tube with open upper and lower ends.

3. The apparatus of claim 1 in which said lower portion includes a bracket depending from said housing for engaging and securing to the lower end of the door.

4. The apparatus of claim 3 in which said bracket includes a hook for engaging the bottom of the door.

5. The apparatus of claim 1 in which said gripping device includes a flexible element for operably attaching to the door handle.

6. The apparatus of claim 5 in which said actuator includes an elongate shaft attached at an upper end to said flexible element.

7. The apparatus of claim 1 in which said gripping element includes a clamp.

8. The apparatus of claim 7 in which said clamp is secured by a flexible connector to an upper end of said actuator, which actuator includes a shaft.

9. The apparatus of claim 7 in which said actuator includes a shaft having an offset upper extension arm pivotably connected to said shaft and being movable longitudinally downwardly in response to depression of said pedal such that said arm drives said clamp to rotate the door handle to open the door.

10. The apparatus of claim 1 in which said actuator includes a shaft longitudinally movable within said housing.

11. The apparatus of claim 1 in which said gripping device and said actuator comprise an elongate flexible element for interconnecting between the handle and the foot pedal.

12. The apparatus of claim 1 in which said intermediate portion includes an elongate body and said upper portion includes a mounting plate for being interengaged with and held by one of a door handle and a door push plate.

13. The apparatus of claim 12 in which said mounting plate includes openings that enable the mounting plate to be secured to the door and engaged with one of the handle and the door push plate.

14. The apparatus of claim 12 in which said foot pedal is secured directly to a lower end of said body; said lower end of said body further carrying said lower portion which includes a bracket for interengaging the bottom of the door.

15. The apparatus of claim 1 in which said intermediate portion includes a tube and a flexible element that extends through said tube, an upper end of said flexible element being attached to said gripping device and lower end of said flexible element being attached to said pedal.

16. The apparatus of claim 15 in which said lower portion includes a generally vertical track for slidably accommodating said foot pedal, said flexible element being connected proximate a lower end thereof to said foot pedal and being connected proximate an upper end thereof to said gripping device whereby depressing said foot pedal causes said flexible element to turn said clamping device and said handle for unlatching the door.

17. A foot operated door opener comprising:

an elongate assembly for interconnecting a door handle and a bottom end of the door, said elongate assembly including an upper portion for mounting to the door handle on a first side of the door, a lower portion for securing the bottom of the door and an intermediate portion interconnecting said upper and lower portions and for extending along a first side of the door between the handle and the lower end of the door; and a foot pedal attached to said intermediate portion for being engaged by a person's foot and selectively pushed or pulled to open the door;

said upper portion including a device for operably gripping the door handle and said intermediate portion including an actuator attached to said gripping device such that when said pedal is depressed, said gripping device operates said handle to release the door's latch and allow the door to be opened by pulling or pushing the door pedal; said intermediate portion further including an elongate housing that slidably receives said actuator and said upper portion further including a mounting piece for releasably engaging said housing to a mounting shaft of the door handle; said lower portion including a bracket depending from said housing for engaging and securing to the lower end of the door; said bracket including a hook for wrapping about a lower end of the door and directly engaging the bottom edge and both opposing sides of the door; said foot pedal being held permanently in a nonpivoting, generally horizontal condition.

18. A foot operated door opener comprising:

a bracket for engaging and securing to the lower end of the door, said bracket including a hook-shaped component for wrapping about a lower end of the door and directly engaging the bottom edge and both lower opposing sides of the door;

a foot pedal for extending generally horizontally from an inside surface of the door; and means for interconnecting the foot pedal to said bracket such that said foot pedal is engageable by a person's foot and selectively pulled in an inward direction to open the door when the door is unlatched, said foot pedal being fixedly attached and immovable relative to said bracket.

* * * * *